US010465138B2

(12) United States Patent
Walter et al.

(10) Patent No.: US 10,465,138 B2
(45) **Date of Patent: *Nov. 5, 2019**

(54) USE OF A COMPLEX ESTER TO REDUCE FUEL CONSUMPTION

(71) Applicant: BASF SE, Ludwigshafen (DE)

(72) Inventors: Marc Walter, Frankenthal (DE); Dirk Rettemeyer, Hueckelhoven (DE); Markus Hansch, Speyer (DE); Ludwig Voelkel, Limburgerhof (DE); Bjoern Thomas Hahn, Duesseldorf (DE); Muriel Ecormier, Mannheim (DE); Thomas Hayden, Wappingers Falls Dutchess, NY (US)

(73) Assignee: BASF SE, Ludwigshafen (DE)

( * ) Notice: Subject to any disclaimer, the term of this patent is extended or adjusted under 35 U.S.C. 154(b) by 0 days.

This patent is subject to a terminal disclaimer.

(21) Appl. No.: 16/017,149

(22) Filed: Jun. 25, 2018

(65) Prior Publication Data

US 2018/0305631 A1 Oct. 25, 2018

Related U.S. Application Data

(60) Division of application No. 15/031,114, filed as application No. PCT/EP2014/072384 on Oct. 20, 2014, now Pat. No. 10,030,206, which is a continuation of application No. 14/062,320, filed on Oct. 24, 2013, now abandoned.

(51) Int. Cl.

| | |
|---|---|
| ***C10L 10/08*** | (2006.01) |
| ***C10L 1/19*** | (2006.01) |
| ***C10M 129/78*** | (2006.01) |
| ***C10L 10/04*** | (2006.01) |
| ***C10L 10/18*** | (2006.01) |
| ***C10L 1/18*** | (2006.01) |
| ***C10L 1/22*** | (2006.01) |
| *C10L 1/16* | (2006.01) |
| *C10L 1/2383* | (2006.01) |
| *C10L 1/222* | (2006.01) |

(52) U.S. Cl.

CPC ..... *C10L 10/08* (2013.01); *C10L 1/18* (2013.01); *C10L 1/1915* (2013.01); *C10L 1/22* (2013.01); *C10L 10/04* (2013.01); *C10L 10/18* (2013.01); *C10M 129/78* (2013.01); *C10L 1/1608* (2013.01); *C10L 1/2222* (2013.01); *C10L 1/2383* (2013.01); *C10L 2200/0423* (2013.01); *C10L 2230/22* (2013.01); *C10L 2270/023* (2013.01); *C10M 2207/30* (2013.01); *C10N 2230/06* (2013.01); *C10N 2270/00* (2013.01)

(58) Field of Classification Search

CPC ..... C10L 10/08; C10L 1/1916; C10L 10/04; C10L 1/18; C10L 2230/22; C10L 1/1608; C10L 2200/0423

See application file for complete search history.

(56) References Cited

U.S. PATENT DOCUMENTS

| | | | | |
|---|---|---|---|---|
| 4,617,026 | A * | 10/1986 | Shaub | C10L 1/1985 44/389 |
| 4,849,572 | A | 7/1989 | Chen et al. | |
| 4,877,416 | A | 10/1989 | Campbell | |
| 6,462,001 | B1 | 10/2002 | Kenbeek et al. | |
| 6,828,287 | B1 | 12/2004 | Lakes et al. | |
| 8,449,630 | B2 | 5/2013 | Lange et al. | |
| 10,030,206 | B2 * | 7/2018 | Walter | C10L 1/1915 |

FOREIGN PATENT DOCUMENTS

| | | |
|---|---|---|
| DE | 38 26 608 A1 | 2/1990 |
| DE | 38 38 918 A1 | 5/1990 |
| DE | 41 42 241 A1 | 6/1993 |
| DE | 43 09 074 A1 | 9/1994 |
| DE | 196 20 262 A1 | 11/1997 |
| DE | 101 02 913 A1 | 7/2002 |
| EP | 0 244 616 A2 | 11/1987 |
| EP | 0 307 815 A1 | 3/1989 |
| EP | 0 310 875 A1 | 4/1989 |
| EP | 0 356 725 A1 | 3/1990 |
| EP | 0 452 328 A1 | 10/1991 |
| EP | 0 476 485 A1 | 3/1992 |
| EP | 0 548 617 A2 | 6/1993 |
| EP | 0 608 149 A1 | 7/1994 |
| EP | 0 639 632 A1 | 2/1995 |
| EP | 0 700 985 A1 | 3/1996 |

(Continued)

OTHER PUBLICATIONS

International Search Report dated Jul. 2, 2015 in PCT/EP2014/072384.

International Preliminary Report on Patentability dated Apr. 26, 2016 in PCT/EP2014/072384.

Written Opinion dated Jul. 2, 2015 in PCT/EP2014/072384 filed Oct. 20, 2014.

*Primary Examiner* — Cephia D Toomer

(74) *Attorney, Agent, or Firm* — Oblon, McClelland, Maier & Neustadt, L.L.P.

(57) ABSTRACT

The use of a complex ester obtainable by esterification reaction between aliphatic linear or branched $C_2$- to $C_{12}$-dicarboxylic acids, aliphatic linear or branched polyhydroxy alcohols with 3 to 6 hydroxyl groups, and, as chain stopping agents, aliphatic linear or branched $C_1$- to $C_{30}$-monocarboxylic acids or aliphatic linear or branched monobasic $C_1$- to $C_{30}$-alcohols, as an additive in a fuel for minimization of power loss in the operation of an internal combustion engine with this fuel.

6 Claims, No Drawings

(56) References Cited

FOREIGN PATENT DOCUMENTS

| | | | |
|---|---|---|---|
| EP | 0 831 141 | A1 | 3/1998 |
| RU | 2 161 640 | C2 | 1/2001 |
| RU | 2 280 066 | C2 | 7/2006 |
| SU | 458252 | A1 | 4/1984 |
| WO | WO 87/01126 | A1 | 2/1987 |
| WO | WO 91/03529 | A1 | 3/1991 |
| WO | WO 94/24231 | A1 | 10/1994 |
| WO | WO 96/03367 | A1 | 2/1996 |
| WO | WO 96/03479 | A1 | 2/1996 |
| WO | WO 97/03946 | A1 | 2/1997 |
| WO | WO 98/11178 | A1 | 3/1998 |
| WO | WO 99/16849 | A1 | 4/1999 |
| WO | WO 00/47698 | A1 | 8/2000 |
| WO | WO 03/012015 | A2 | 2/2003 |
| WO | WO 2004/026997 | A2 | 4/2004 |
| WO | WO 2004/050806 | | 6/2004 |
| WO | WO 2004/090079 | A1 | 10/2004 |

* cited by examiner

USE OF A COMPLEX ESTER TO REDUCE FUEL CONSUMPTION

CROSS-REFERENCE TO RELATED APPLICATIONS

The present application is a Division of U.S. Ser. No. 15/031,114, filed Apr. 21, 2016, 10 now allowed, which is a 371 of PCT/EP2014/072384, filed Oct. 20, 2014, which is a Continuation of U.S. Ser. No. 14/062,320, filed Oct. 24, 2013, now abandoned.

DESCRIPTION

The present invention relates to the use of a complex ester obtainable by an esterification reaction between (A) at least one aliphatic linear or branched $C_2$- to $C_{12}$-dicarboxylic acid, (B) at least one aliphatic linear or branched polyhydroxy alcohol with 3 to 6 hydroxyl groups, and (C) as a chain stopping agent (C1) at least one aliphatic linear or branched $C_1$- to $C_{30}$-monocarboxylic acid in case of an excess of component (B), or (C2) at least one aliphatic linear or branched monobasic $C_1$- to $C_{30}$-alcohol in case of an excess of component (A), as an additive in a fuel for different purposes.

The present invention further relates to a fuel composition which comprises a gasoline fuel, the complex ester mentioned and at least one fuel additive with detergent action.

The present invention further relates to an additive concentrate which comprises the complex ester mentioned and at least one fuel additive with detergent action.

It is known that particular substances in the fuel reduce internal friction in the internal combustion engines, especially in gasoline engines, and thus help to save fuel. Such substances are also referred to as lubricity improvers, friction reducers or friction modifiers. Lubricity improvers customary on the market for gasoline fuels are usually condensation products of naturally occurring carboxylic acids such as fatty acids with polyols such as glycerol or with alkanolamines, for example glyceryl monooleate.

A disadvantage of the prior art lubricity improvers mentioned is poor miscibility with other typically used fuel additives, especially with detergent additives such as polyisobuteneamines and/or carrier oils such as polyalkylene oxides. An important requirement in practice is that the component mixtures or additive concentrates provided are readily pumpable even at relatively low temperatures, especially at outside winter temperatures of, for example, down to −20° C., and remain homogeneously stable over a prolonged period, i.e. no phase separation and/or precipitates may occur.

Typically, the miscibility problems outlined are avoided by adding relatively large amounts of mixtures of paraffinic or aromatic hydrocarbons with alcohols such as tert-butanol or 2-ethylhexanol as solubilizers to the component mixtures or additive concentrates. In some cases, however, considerable amounts of these expensive solubilizers are necessary in order to achieve the desired homogeneity, and so this solution to the problem becomes uneconomic.

In addition, the prior art lubricity improvers mentioned often have the tendency to form emulsions with water in the component mixtures or additive concentrates or in the fuel itself, such that water which has penetrated can be removed again via a phase separation only with difficulty or at least only very slowly.

WO 99/16849 discloses a complex ester resulting from an esterification reaction between polyfunctional alcohols and polyfunctional carboxylic acids using a chain stopping agent to form ester bonds with the remaining hydroxyl or carboxyl groups, containing as a polyfunctional carboxylic acid component dimerised and/or trimerised fatty acids. This complex ester is recommended for as an additive, a base fluid or a thickener in transmission oils, hydraulic fluids, four-stroke oils, fuel additives, compressor oils, greases, chain oils and for metal working rolling applications.

WO 98/11178 discloses a polyol ester distillate fuel additive synthesized from a polyol an a mono- or polycarboxylic acid in such a manner that the resulting ester has unconverted hydroxyl groups, such polyol ester being useful as a lubricity additive for diesel fuel, jet fuel and kerosene.

WO 03/012015 discloses an additive for improving the lubricity capacity of low-sulphur fuel oils, such additive containing an ester of a bivalent or polyvalent alcohol and a mixture of unsaturated or saturated mono- or dicarboxylic acids whose carbon length are between 8 and 30 carbon atoms.

It was an object of the present invention to provide fuel additives which firstly bring about effective fuel saving in the operation of a spark-ignited internal combustion engine, and secondly no longer have the outlined shortcomings of the prior art, i.e. more particularly not remaining homogeneously stable over a prolonged period without any phase separation and/or precipitates, poor miscibility with other fuel additives and the tendency to form emulsions with water. In addition, they should not worsen the high level of intake valve cleanliness achieved by the modern fuel additives.

Accordingly, the use of a complex ester as described above as an additive in a fuel for reducing fuel consumption in the operation of an internal combustion engine with this fuel has been found. Preferably, the said use as an additive in a gasoline fuel for reducing fuel consumption in the operation of a spark-ignited internal combustion engine with this fuel or as an additive in a gasoline fuel for reduction of fuel consumption in the operation of a self-ignition internal combustion engine with this fuel has been found.

It can be assumed that the cause of the fuel saving by virtue of the complex ester mentioned is based substantially on the effect thereof as an additive which reduces internal friction in the internal combustion engines, especially in gasoline engines. The reaction product mentioned thus functions in the context of the present invention essentially as a lubricity improver.

Furthermore, the use of a complex ester as described above as an additive in a fuel for minimization of power loss in internal combustion engines and for improving acceleration of internal combustion engines has been found.

Furthermore, the use of a complex ester as described above as an additive in a fuel for improving the lubricity of lubricant oils contained in an internal combustion engine for lubricating purposes by operating the internal combustion engine with a fuel containing an effective amount of at least one of the said complex esters has been found.

It can be assumed that a part of the complex ester mentioned contained in the fuel is transported via the combustion chamber where the additive containing fuel is burnt into the lubricant oils and acting there as a further lubricating agent. The advantage of this mechanism is that the said further lubricating agent is continuously refreshed by the fuel feeding.

Spark-ignition internal combustion engines are preferably understood to mean gasoline engines, which are typically ignited with spark plugs. In addition to the customary four- and two-stroke gasoline engines, spark-ignition internal combustion engines also include other engine types, for example the Wankel engine. These are generally engines which are operated with conventional gasoline types, especially gasoline types according to EN 228, gasoline-alcohol mixtures such as Flex fuel with 75 to 85% by volume of ethanol, liquid pressure gas ("LPG") or compressed natural gas ("CNG") as fuel.

However, the inventive use of the complex ester mentioned also relates to newly developed internal combustion engines such as the "HCCI" engine, which is self-igniting and is operated with gasoline fuel.

The instant invention works preferably with direct injection gasoline driven combustion engines.

The aliphatic dicarboxylic acids of component (A) may be branched or preferably linear; they may be unsaturated or preferably saturated. Typical examples for component (A) are ethanedioic acid (oxalic acid), propanedioic acid (malonic acid), butanedioic acid (succinic acid), (Z)-butenedioic acid (maleic acid), (E)-butenedioic acid (fumaric acid), pentanedioic acid (glutaric acid), pent-2-enedioic acid (glutaconic acid), hexanedioic acid (adipic acid), heptanedioic acid (pimelic acid), octanedioic acid (suberic acid), nonanedioic acid (azelaic acid), decanedioic acid (sebacic acid), undecanedioic acid, dodecanedioic acid, dodec-2-enedioic acid (traumatic acid) and (2E,4E)-hexa-2,4-dienedioic acid (muconic acid). Mixture of the above aliphatic dicarboxylic acids can also be used.

In a preferred embodiment, the at least one aliphatic dicarboxylic acid of component (A) is selected from aliphatic linear $C_6$- to $C_{10}$-dicarboxylic acids which are preferably saturated. Most preferred are adipic acid and sebacic acid.

The aliphatic polyhydroxy alcohols of component (B) may be branched or linear; they may be unsaturated or preferably saturated; they may contain of form 3 to 12, preferably of from 3 to 8, especially of from 3 to 6 carbon atoms and preferably 3, 4 or 5 hydroxyl groups. Typical examples for component (B) are trimethylolethane, trimethylolpropane, trimethylolbutane, sorbitol, glycerin and pentaerythritol. Mixtures of the above aliphatic polyhydroxy alcohols can also be used.

In a preferred embodiment, the at least one aliphatic polyhydroxy alcohol of component (B) is selected from glycerin, trimethylolpropane and pentaerythritol.

Depending whether component (B) is used for the esterification reaction in an excess compared with component (A), resulting in remaining free hydroxyl groups, or component (A) is used for the esterification reaction in an excess compared with component (B), resulting in remaining free carboxylic groups, chain stopping agent (C1) or (C2) is used for the synthesis of the complex ester mentioned. Carboxylic ester component (C1) will transform remaining free hydroxyl groups into additional carboxylic ester groups. Monobasic alcohol component (C2) will transform remaining free carboxylic groups into additional carboxylic ester groups.

The aliphatic monocarboxylic acids of component (C1) may be branched or linear; they may be unsaturated or preferably saturated. Typical examples for component (A) are formic acid, acetic acid, propionic acid, 2,2-dimethyl propionic acid (neopentanoic acid), hexanoic acid, octanoic acid (caprylic acid), 2-ethylhexanoic acid, 3,5,5-trimethyl hexanoic acid, nonanoic acid, decanoic acid (capric acid), undecanoic acid, dodecanoic acid (lauric acid), tridecanoic acid, tetradecanoic acid (myristic acid), hexadecanoic acid (palmitic acid), octadecanoic acid (stearic acid), isostearic acid, oleic acid, linoleic acid, linolaidic acid, erucic acid, arachidic acid, behenic acid, lignoceric acid and cerotic acid. The above monocarboxylic acids, including the so called fatty acids, may be of synthetic or of natural origin. Mixtures of the above aliphatic monocarboxylic acids can also be used.

In a preferred embodiment, the at least one aliphatic monocarboxylic acid of component (C1) is selected from aliphatic linear or branched $C_8$- to $C_{18}$-monocarboxylic acids.

The aliphatic monobasic alcohols of component (C2) may be branched or linear; they may be unsaturated or preferably saturated. Typical examples for component (C2) are methanol, ethanol, n-propanol, iso-propanol, n-butanol, iso-butanol, sec-butanol, tert-butanol, n-pentanol, n-hexanol, n-heptanol, n-octanol, 2-ethylhexanol, n-nonanol, 2-propylheptanol, n-decanol, n-undecanol, n-dodecanol, n-tridecanol, iso-tridecanol, n-tetradecanol, iso-tetradecanol, n-hexadecanol, n-octadecanol, iso-octadecanol and n-eicosanol. Mixtures of the above monobasic alcohols can also be used. The said monobasic alcohols may have been alkoxylated by means of hydrocarbyl epoxides like ethylene oxide, propylene oxide and/or butylene oxide resulting in monocapped polyethers before being used as chain stopping agents for preparing the complex esters mentioned.

In a preferred embodiment, the at least one aliphatic monobasic alcohol of component (C2) is selected from linear or branched $C_8$- to $C_{18}$-alkanols.

The synthesis of the complex ester mentioned is in principle known in the art. In more detail, it can be prepared by mixing and reacting component (A) with (B) and subsequently reacting the intermediate ester formed by (A) and (B) with component (C). As an alternative, it can also be prepared by mixing an reacting components (A), (B) and (C) simultaneously.

The complex ester mentioned is normally composed of at least 2 molecule units of component (A), at least 3 molecule units of component (B) and the corresponding number of molecule units of chain stopping agent (C), or of at least 2 molecule units of component (B), at least 3 molecule units of component (A) and the corresponding number of molecule units of chain stopping agent (C).

In a preferred embodiment, the complex ester mentioned is composed of from 2 to 9 molecule units, especially of from 2 to 5 molecule units of component (A) and of from 3 to 10 molecule units, especially of from 3 to 6 molecule units of component (B), component (B) being in excess compared with component (A), with remaining free hydroxyl groups of (B) being completely or partly capped with a corresponding number of molecule units of component (C1).

In another preferred embodiment, the complex ester mentioned is composed of from 3 to 10 molecule units, especially of from 3 to 6 molecule units of component (A) and of from 2 to 9 molecule units, especially of from 2 to 5 molecule units of component (B), component (A) being in excess compared with component (B), with remaining free carboxyl groups of (A) being completely or partly capped with a corresponding number of molecule units of component (C2).

A typical complex ester useful for the instant invention is composed of 3 or 4 molecule units of component (A), especially of at least one aliphatic linear $C_6$- to $C_{10}$-dicarboxylic acid such as adipic acid and/or sebacic acid, of 4 or 5 molecule units of component (B), especially of glycerin, trimethylolpropane and/or pentaerythritol, and of 6 to 12 molecule units of component (C1), especially of at least one aliphatic linear or branched $C_8$- to $C_{18}$-monocarboxylic acid such as octanoic acid, 2-ethylhexanoic acid, 3,5,5-trimethyl hexanoic acid, nonanoic acid, decanoic acid and/or isostearic acid.

The complex ester mentioned is oil soluble, which means that, when mixed with mineral oils and/or fuels in a weight ratio of 10:90, 50:50 and 90:10, the complex ester does not show phase separation after standing for 24 hours at room temperature for at least two weight rations out of the three weight ratios 10:90, 50:50 and 90:10.

The present invention also provides a fuel composition which comprises, in a major amount, a gasoline fuel and, in a minor amount, at least one complex ester mentioned, and at least one fuel additive which is different from the said complex esters and has detergent action.

Typically, the amount of this at least one complex ester in the gasoline fuel is 10 to 5000 ppm by weight, more preferably 20 to 2000 ppm by weight, even more preferably 30 to 1000 ppm by weight and especially 40 to 500 ppm by weight, for example 50 to 300 ppm by weight.

Useful gasoline fuels include all conventional gasoline fuel compositions. A typical representative which shall be mentioned here is the Eurosuper base fuel to EN 228, which is customary on the market. In addition, gasoline fuel compositions of the specification according to WO 00/47698 are also possible fields of use for the present invention. In addition, in the context of the present invention, gasoline fuels shall also be understood to mean alcohol-containing gasoline fuels, especially ethanol-containing gasoline fuels, as described, for example, in WO 2004/090079, for example Flex fuel with an ethanol content of 75 to 85% by volume, or gasoline fuel comprising 85% by volume of ethanol ("E85"), but also the "E100" fuel type, which is typically azeotropically distilled ethanol and thus consists of approx. 96% by volume of $C_2H_5OH$ and approx. 4% by volume of $H_2O$.

The complex ester mentioned may be added to the particular base fuel either alone or in the form of fuel additive packages (for gasoline fuels also called "gasoline performance packages). Such packages are fuel additive concentrates and generally also comprise, as well as solvents, and as well as the at least one fuel additive which is different from the said complex esters and has detergent action, a series of further components as coadditives, which are especially carrier oils, corrosion inhibitors, demulsifiers, dehazers, antifoams, combustion improvers, antioxidants or stabilizers, antistats, metallocenes, metal deactivators, solubilizers, markers and/or dyes.

Detergents or detergent additives as the at least one fuel additive which is different from the said complex esters and has detergent action, referred to hereinafter as component (D), typically refer to deposition inhibitors for fuels. The detergent additives are preferably amphiphilic substances which possess at least one hydrophobic hydrocarbyl radical having a number-average molecular weight ($M_n$) of 85 to 20 000, especially of 300 to 5000, in particular of 500 to 2500, and at least one polar moiety.

In a preferred embodiment, the inventive fuel composition comprises, as the at least one fuel additive (D) which is different from the said complex esters and has detergent action, at least one representative which is selected from:

(Da) mono- or polyamino groups having up to 6 nitrogen atoms, at least one nitrogen atom having basic properties;

(Db) nitro groups, optionally in combination with hydroxyl groups;

(Dc) hydroxyl groups in combination with mono- or polyamino groups, at least one nitrogen atom having basic properties;

(Dd) carboxyl groups or their alkali metal or alkaline earth metal salts;

(De) sulfo groups or their alkali metal or alkaline earth metal salts;

(Df) polyoxy-$C_2$-$C_4$-alkylene moieties terminated by hydroxyl groups, mono- or polyamino groups, at least one nitrogen atom having basic properties, or by carbamate groups;

(Dg) carboxylic ester groups;

(Dh) moieties derived from succinic anhydride and having hydroxyl and/or amino and/or amido and/or imido groups; and/or (Di) moieties obtained by Mannich reaction of substituted phenols with aldehydes and mono- or polyamines.

The hydrophobic hydrocarbon radical in the above detergent additives, which ensures the adequate solubility in the fuel composition, has a number-average molecular weight ($M_n$) of 85 to 20 000, especially of 300 to 5000, in particular of 500 to 2500. Useful typical hydrophobic hydrocarbyl radicals, especially in conjunction with the polar moieties (Da), (Dc), (Dh) and (Di), are relatively long-chain alkyl or alkenyl groups, especially the polypropenyl, polybutenyl and polyisobutenyl radicals each having $M_n$=300 to 5000, especially 500 to 2500, in particular 700 to 2300.

Examples of the above groups of detergent additives include the following:

Additives comprising mono- or polyamino groups (Da) are preferably polyalkenemono- or polyalkenepolyamines based on polypropene or on highly-reactive (i.e. having predominantly terminal double bonds in the α- and/or β-position such as vinylidene double bonds) or conventional (i.e. having predominantly internal double bonds) polybutene or polyisobutene having $M_n$=300 to 5000. Such detergent additives based on highly-reactive polybutene or polyisobutene, which are normally prepared by hydroformylation of the poly(iso)butene and subsequent reductive amination with ammonia, monoamines or polyamines, are known from EP-A 244 616. When the preparation of the additives proceeds from polybutene or polyisobutene having predominantly internal double bonds (usually in the β- and/or γ-positions), one possible preparative route is by chlorination and subsequent amination or by oxidation of the double bond with air or ozone to give the carbonyl or carboxyl compound and subsequent amination under reductive (hydrogenating) conditions. The amines used here for the amination may be, for example, ammonia, monoamines or polyamines such as dimethylaminopropylamine, ethylenediamine, diethylenetriamine, triethylenetetramine or tetraethylenepentamine. Corresponding additives based on polypropene are described in particular in WO-A-94/24231.

Further preferred additives comprising monoamino groups (Da) are the hydrogenation products of the reaction products of polyisobutenes having an average degree of polymerization P=5 to 100 with nitrogen oxides or mixtures of nitrogen oxides and oxygen, as described in particular in WO-A-97/03946.

Further preferred additives comprising monoamino groups (Da) are the compounds obtainable from polyisobutene epoxides by reaction with amines and subsequent dehydration and reduction of the amino alcohols, as described in particular in DE-A-196 20 262.

Additives comprising nitro groups (Db), optionally in combination with hydroxyl groups, are preferably reaction products of polyisobutenes having an average degree of polymerization P=5 to 100 or 10 to 100 with nitrogen oxides or mixtures of nitrogen oxides and oxygen, as described in particular in WO-A-96/03367 and in WO-A 96/03479. These reaction products are generally mixtures of pure nitropolyisobutenes (e.g. α,β-dinitropolyisobutene) and mixed hydroxynitropolyisobutenes (e.g. α-nitro-β-hydroxypolyisobutene).

Additives comprising hydroxyl groups in combination with mono- or polyamino groups (Dc) are in particular reaction products of polyisobutene epoxides obtainable from polyisobutene having preferably predominantly terminal double bonds and $M_n$=300 to 5000, with ammonia or mono- or polyamines, as described in particular in EP-A-476 485.

Additives comprising carboxyl groups or their alkali metal or alkaline earth metal salts (Dd) are preferably copolymers of $C_2$-$C_{40}$-olefins with maleic anhydride which have a total molar mass of 500 to 20 000 and some or all of whose carboxyl groups have been converted to the alkali metal or alkaline earth metal salts and any remainder of the carboxyl groups has been reacted with alcohols or amines. Such additives are disclosed in particular by EP-A-307 815. Such additives serve mainly to prevent valve seat wear and can, as described in WO-A-87/01126, advantageously be used in combination with customary fuel detergents such as poly(iso)buteneamines or polyetheramines.

Additives comprising sulfo groups or their alkali metal or alkaline earth metal salts (De) are preferably alkali metal or alkaline earth metal salts of an alkyl sulfosuccinate, as described in particular in EP-A-639 632. Such additives serve mainly to prevent valve seat wear and can be used advantageously in combination with customary fuel detergents such as poly(iso)buteneamines or polyetheramines.

Additives comprising polyoxy-$C_2$-$C_4$-alkylene moieties (Df) are preferably polyethers or polyetheramines which are obtainable by reaction of $C_2$-$C_{60}$-alkanols, $C_6$-$C_{30}$-alkanediols, mono- or di-$C_2$-$C_{30}$-alkylamines, $C_1$-$C_{30}$-alkylcyclohexanols or $C_1$-$C_{30}$-alkylphenols with 1 to 30 mol of ethylene oxide and/or propylene oxide and/or butylene oxide per hydroxyl group or amino group and, in the case of the polyetheramines, by subsequent reductive amination with ammonia, monoamines or polyamines. Such products are described in particular in EP-A-310 875, EP-A-356 725, EP-A-700 985 and U.S. Pat. No. 4,877,416. In the case of polyethers, such products also have carrier oil properties. Typical examples of these are tridecanol butoxylates, isotridecanol butoxylates, isononyl-phenol butoxylates and polyisobutenol butoxylates and propoxylates and also the corresponding reaction products with ammonia.

Additives comprising carboxylic ester groups (Dg) are preferably esters of mono-, di- or tricarboxylic acids with long-chain alkanols or polyols, in particular those having a minimum viscosity of 2 $mm^2/s$ at 100° C., as described in particular in DE-A-38 38 918. The mono-, di- or tricarboxylic acids used may be aliphatic or aromatic acids, and particularly suitable ester alcohols or ester polyols are long-chain representatives having, for example, 6 to 24 carbon atoms. Typical representatives of the esters are adipates, phthalates, isophthalates, terephthalates and trimellitates of isooctanol, of isononanol, of isodecanol and of isotridecanol. Such products also have carrier oil properties.

Additives comprising moieties derived from succinic anhydride and having hydroxyl and/or amino and/or amido and/or imido groups (Dh) are preferably corresponding derivatives of alkyl- or alkenyl-substituted succinic anhydride and especially the corresponding derivatives of polyisobutenylsuccinic anhydride which are obtainable by reacting conventional or high-reactivity polyisobutene having $M_n$=300 to 5000 with maleic anhydride by a thermal route or via the chlorinated polyisobutene. Of particular interest in this context are derivatives with aliphatic polyamines such as ethylenediamine, diethylenetriamine, triethylenetetramine or tetraethylenepentamine. The moieties having hydroxyl and/or amino and/or amido and/or imido groups are, for example, carboxylic acid groups, acid amides of monoamines, acid amides of di- or polyamines which, in addition to the amide function, also have free amine groups, succinic acid derivatives having an acid and an amide function, carboximides with monoamines, carboximides with di- or polyamines which, in addition to the imide function, also have free amine groups, or diimides which are formed by the reaction of di- or polyamines with two succinic acid derivatives. Such fuel additives are described especially in U.S. Pat. No. 4,849,572.

The detergent additives from group (Dh) are preferably the reaction products of alkyl- or alkenyl-substituted succinic anhydrides, especially of polyisobutenylsuccinic anhydrides ("PIBSAs"), with amines and/or alcohols. These are thus derivatives which are derived from alkyl-, alkenyl- or polyisobutenylsuccinic anhydride and have amino and/or amido and/or imido and/or hydroxyl groups. It is self-evident that these reaction products are obtainable not only when substituted succinic anhydride is used, but also when substituted succinic acid or suitable acid derivatives, such as succinyl halides or succinic esters, are used.

The additized fuel may comprise at least one detergent based on a polyisobutenyl-substituted succinimide. Especially of interest are the imides with aliphatic polyamines. Particularly preferred polyamines are ethylenediamine, diethylenetriamine, triethylenetetramine, pentaethylenehexamine and in particular tetraethylenepentamine. The polyisobutenyl radical has a number-average molecular weight $M_n$ of preferably from 500 to 5000, more preferably from 500 to 2000 and in particular of about 1000.

Additives comprising moieties (Di) obtained by Mannich reaction of substituted phenols with aldehydes and mono- or polyamines are preferably reaction products of polyisobutene-substituted phenols with formaldehyde and mono- or polyamines such as ethylenediamine, diethylenetriamine, triethylenetetramine, tetraethylenepentamine or dimethylaminopropylamine. The polyisobutenyl-substituted phenols may originate from conventional or high-reactivity polyisobutene having $M_n$=300 to 5000. Such "polyisobutene Mannich bases" are described especially in EP-A-831 141.

The inventive fuel composition comprises the at least one fuel additive which is different from the complex ester mentioned and has detergent action, and is normally selected from the above groups (Da) to (Di), in an amount of typically 10 to 5000 ppm by weight, more preferably of 20 to 2000 ppm by weight, even more preferably of 30 to 1000 ppm by weight and especially of 40 to 500 ppm by weight, for example of 50 to 250 ppm by weight.

The detergent additives (D) mentioned are preferably used in combination with at least one carrier oil. In a preferred embodiment, the inventive fuel composition comprises, in addition to the at least one inventive reaction product and the at least one fuel additive which is different than the inventive reaction product and has detergent action, as a further fuel additive in a minor amount, at least one carrier oil.

Suitable mineral carrier oils are the fractions obtained in crude oil processing, such as brightstock or base oils having viscosities, for example, from the SN 500-2000 class; but also aromatic hydrocarbons, paraffinic hydrocarbons and alkoxyalkanols. Likewise useful is a fraction which is obtained in the refining of mineral oil and is known as "hydrocrack oil" (vacuum distillate cut having a boiling range of from about 360 to 500° C., obtainable from natural mineral oil which has been catalytically hydrogenated under high pressure and isomerized and also deparaffinized). Likewise suitable are mixtures of abovementioned mineral carrier oils.

Examples of suitable synthetic carrier oils are selected from: polyolefins (poly-alpha-olefins or poly(internal olefin)s), (poly)esters, (poly)alkoxylates, polyethers, aliphatic polyetheramines, alkylphenol-started polyethers, alkylphenol-started polyetheramines and carboxylic esters of long-chain alkanols.

Examples of suitable polyolefins are olefin polymers having $M_n$=from 400 to 1800, in particular based on polybutene or polyisobutene (hydrogenated or unhydrogenated).

Examples of suitable polyethers or polyetheramines are preferably compounds comprising polyoxy-$C_2$-$C_4$-alkylene moieties which are obtainable by reacting $C_2$-$C_{60}$-alkanols, $C_6$-$C_{30}$-alkanediols, mono- or di-$C_2$-$C_{30}$-alkylamines, $C_1$-$C_{30}$-alkylcyclohexanols or $C_1$-$C_{30}$-alkylphenols with from 1 to 30 mol of ethylene oxide and/or propylene oxide and/or butylene oxide per hydroxyl group or amino group, and, in the case of the polyetheramines, by subsequent reductive amination with ammonia, monoamines or polyamines. Such products are described in particular in EP-A-310 875, EP-A-356 725, EP-A-700 985 and U.S. Pat. No. 4,877,416. For example, the polyether-amines used may be poly-$C_2$-$C_6$-alkylene oxide amines or functional derivatives thereof. Typical examples thereof are tridecanol butoxylates or isotridecanol butoxylates, isononylphenol butoxylates and also polyisobutenol butoxylates and propoxylates, and also the corresponding reaction products with ammonia.

Examples of carboxylic esters of long-chain alkanols are in particular esters of mono-, di- or tricarboxylic acids with long-chain alkanols or polyols, as described in particular in DE-A-38 38 918. The mono-, di- or tricarboxylic acids used may be aliphatic or aromatic acids; suitable ester alcohols or polyols are in particular long-chain representatives having, for example, from 6 to 24 carbon atoms. Typical representatives of the esters are adipates, phthalates, isophthalates, terephthalates and trimellitates of isooctanol, isononanol, isodecanol and isotridecanol, for example di(n- or isotridecyl) phthalate.

Further suitable carrier oil systems are described, for example, in DE-A-38 26 608, DE-A-41 42 241, DE-A-43 09 074, EP-A-0 452 328 and EP-A-0 548 617.

Examples of particularly suitable synthetic carrier oils are alcohol-started polyethers having from about 5 to 35, for example from about 5 to 30, $C_3$-$C_6$-alkylene oxide units, for example selected from propylene oxide, n-butylene oxide and isobutylene oxide units, or mixtures thereof. Nonlimiting examples of suitable starter alcohols are long-chain alkanols or phenols substituted by long-chain alkyl in which the long-chain alkyl radical is in particular a straight-chain or branched $C_6$-$C_{18}$-alkyl radical. Preferred examples include tridecanol and nonylphenol.

Further suitable synthetic carrier oils are alkoxylated alkylphenols, as described in DE-A-101 02 913.

Preferred carrier oils are synthetic carrier oils, particular preference being given to poly-ethers.

When a carrier oil is used in addition, it is added to the inventive additized fuel in an amount of preferably from 1 to 1000 ppm by weight, more preferably from 10 to 500 ppm by weight and in particular from 20 to 100 ppm by weight.

In a preferred embodiment, the inventive fuel composition comprises, in addition to the at least one inventive reaction product, the at least one fuel additive which is different from the complex ester mentioned and has detergent action, and optionally the at least one carrier oil, as a further fuel additive in a minor amount at least one tertiary hydrocarbyl amine of formula $NR^1R^2R^3$ wherein $R^1$, $R^2$ and $R^3$ are the same or different $C_1$- to $C_{20}$-hydrocarbyl residues with the proviso that the overall number of carbon atoms in formula $NR^1R^2R^3$ does not exceed 30.

Tertiary hydrocarbyl amines have proven to be advantageous with regard to use as performance additives in fuels controlling deposits. Besides their superior performance behavior, they are also good to handle as their melting points are normally low enough to be usually liquid at ambient temperature.

"Hydrocarbyl residue" for $R^1$ to $R^3$ shall mean a residue which is essentially composed of carbon and hydrogen, however, it can contain in small amounts heteroatomes, especially oxygen and/or nitrogen, and/or functional groups, e.g. hydroxyl groups and/or carboxylic groups, to an extent which does not distort the predominantly hydrocarbon character of the residue. Hydrocarbyl residues are preferably alkyl, alkenyl, alkinyl, cycloalkyl, aryl, alkylaryl or arylalkyl groups. Especially preferred hydrocarbyl residues for $R^1$ to $R^3$ are linear or branched alkyl or alkenyl groups.

The overall number of carbon atoms in the tertiary hydrocarbyl amine mentioned is at most 30, preferably at most 27, more preferably at most 24, most preferably at most 20. Preferably, the minimum overall number of carbon atoms in formula $NR^1R^2R^3$ is 6, more preferably 8, most preferably 10. Such size of the tertiary hydrocarbyl amine mentioned corresponds to molecular weight of about 100 to about 450 for the largest range and of about 150 to about 300 for the smallest range; most usually, tertiary hydrocarbyl amines mentioned within a molecular range of from 100 to 300 are used.

The three $C_1$- to $C_{20}$-hydrocarbyl residues may be identical or different. Preferably, they are different, thus creating an amine molecular which exhibits an oleophobic moiety (i.e. the more polar amino group) and an oleophilic moiety (i.e. a hydrocarbyl residue with a longer chain length or a larger volume). Such amine molecules with oleophobic/oleophilic balance have proved to show the best deposit control performance according the present invention.

Preferably, a tertiary hydrocarbyl amine of formula $NR^1R^2R^3$ is used wherein at least two of hydrocarbyl residues $R^1$, $R^2$ and $R^3$ are different with the proviso that the hydrocarbyl residue with the most carbon atoms differ in carbon atom number from the hydrocarbyl residue with the second most carbon atoms in at least 3, preferably in at least 4, more preferably in at least 6, most preferably in at least 8. Thus, the tertiary amines mentioned exhibit hydrocarbyl residues of two or three different chain length or different volume, respectively.

Still more preferably, a tertiary hydrocarbyl amine of formula $NR^1R^2R^3$ is used wherein one or two of $R^1$ to $R^3$ are $C_7$- to $C_{20}$-hydrocarbyl residues and the remaining two or one of $R^1$ to $R^3$ are $C_1$- to $C_4$-hydrocarbyl residues.

The one or the two longer hydrocarbyl residues, which may be in case of two residues identical or different, exhibit from 7 to 20, preferably from 8 to 18, more preferably from 9 to 16, most preferably from 10 to 14 carbon atoms. The one or the two remaining shorter hydrocarbyl residues, which may be in case of two residues identical or different, exhibit from 1 to 4, preferably from 1 to 3, more preferably 1 or 2, most preferably 1 carbon atom(s). Besides the desired deposit controlling performance, the oleophilic long-chain hydrocarbyl residues provide further advantageous properties to the tertiary amines, i.e. high solubility for gasoline fuels and low volatility.

More preferably, tertiary hydrocarbyl amines of formula $NR^1R^2R^3$ are used, wherein $R^1$ is a $C_8$- to $C_{18}$-hydrocarbyl residue and $R^2$ and $R^3$ are independently of each other $C_1$- to $C_4$-alkyl radicals. Still more preferably, tertiary hydrocarbyl amines of formula $NR^1R^2R^3$ are used, wherein $R^1$ is a $C_9$- to $C_{16}$-hydrocarbyl residue and $R^2$ and $R^3$ are both methyl radicals.

Examples for suitable linear or branched $C_1$- to $C_{20}$-alkyl residues for $R^1$ to $R^3$ are: methyl, ethyl, n-propyl, iso-propyl, n-butyl, iso-butyl, sec.-butyl, tert-butyl, n-pentyl, tert-pentyl, 2-methylbutyl, 3-methylbutyl, 1,1-dimethylpropyl, 1,2-dimethylpropyl, n-hexyl, 2-methylpentyl, 3-methylpentyl, 4-methylpentyl, 1,1-dimethylbutyl, 1,2-dimethylbutyl, 1,3-dimethylbutyl, 2-ethylbutyl, n-heptyl, 1-methylhexyl, 2-methylhexyl, 3-methylhexyl, 4-methylhexyl, 5-methylhexyl, 1,1-dimethylpentyl, 1,2-dimethylpentyl, 2,2-dimethylpentyl, 2,3-dimethylpentyl, 2,4-dimethylpentyl, 2,5-dimethylpentyl, 2-diethylpentyl, 3-diethylpentyl, n-octyl, 1-methylheptyl, 2-methylheptyl, 3-methylheptyl, 4-methylheptyl, 5-methylheptyl, 6-methylheptyl, 1,1-dimethylhexyl, 1,2-dimethylhexyl, 2,2-dimethylhexyl, 2,3-dimethylhexyl, 2,4-dimethyl-hexyl, 2,5-dimethylhexyl, 2,6-dimethylhexyl, 2-ethyl-hexyl, 3-ethylhexyl, 4-ethylhexyl, n-nonyl, iso-nonyl, n-decyl, 1-propylheptyl, 2-propyl-heptyl, 3-propyl-heptyl, n-undecyl, n-dodecyl, n-tridecyl, iso-tridecyl, tetradecyl, pentadecyl, hexadecyl, heptadecyl, octadecyl, nonadecyl and eicosyl.

Examples for suitable linear or branched $C_2$- to $C_{20}$-alkenyl and -alkinyl residues for $R^1$ to $R^3$ are: vinyl, allyl, oleyl and propin-2-yl.

Tertiary hydrocarbyl amines of formula $NR^1R^2R^3$ with long-chain alkyl and alkenyl residues can also preferably be obtained or derived from natural sources, i.e. from plant or animal oils and lards. The fatty amines derived from such sources which are suitable as such tertiary hydrocarbyl amines normally form mixtures of differents similar species such as homologues, e.g. tallow amines containing as main components tetradecyl amine, hexadecyl amine, octadecyl amine and octadecenyl amine (oleyl amine). Further examples of suitable fatty amines are: co-co amines and palm amines. Unsaturated fatty amines which contain alkenyl residues can be hydrogenated and used in this saturated form.

Examples for suitable $C_3$- to $C_{20}$-cycloalkyl residues for $R^1$ to $R^3$ are: cyclopropyl, cyclobutyl, 2-methylcyclohexyl, 3-methylcyclohexyl, 4-methylcyclohexyl, 2,3-dimethyl-cyclohexyl, 2,4-dimethylcyclohexyl, 2,5-dimethylcyclohexyl, 2,6-dimethylcyclohexyl, 3,4-dimethylcyclohexyl, 3,5-dimethylcyclohexyl, 2-ethylcyclohexyl, 3-ethylcyclohexyl, 4-ethylcyclohexyl, cyclooctyl and cyclodecyl.

Examples for suitable $C_7$- to $C_{20}$-aryl, -alkylaryl or -arylalkyl residues for $R^1$ to $R^3$ are: naphthyl, tolyl, xylyl, n-octylphenyl, n-nonylphenyl, n-decylphenyl, benzyl, 1-phenyl-ethyl, 2-phenylethyl, 3-phenylpropyl and 4-butylphenyl.

Typical examples for suitable tertiary hydrocarbyl amines of formula $NR^1R^2R^3$ are the following:

N,N-dimethyl-n-butylamine, N,N-dimethyl-n-pentylamine, N,N-dimethyl-n-hexylamine, N,N-dimethyl-n-heptylamine, N,N-dimethyl-n-octylamine, N,N-dimethyl-2-ethylhexyl-amine, N,N-dimethyl-n-nonylamine, N,N-dimethyl-iso-nonylamine, N,N-dimethyl-n-decylamine, N,N-dimethyl-2-propylheptylamine, N,N-dimethyl-n-undecylamine, N,N-dimethyl-n-dodecylamine, N,N-dimethyl-n-tridecylamine, N,N-dimethyl-iso-tridecyl-amine, N,N-dimethyl-n-tetradecylamine, N,N-dimethyl-n-hexadecylamine, N,N-di-methyl-n-octadecylamine, N,N-dimethyl-eicosylamine, N,N-dimethyl-oleylamine;

N,N-diethyl-n-heptylamine, N,N-diethyl-n-octylamine, N,N-diethyl-2-ethylhexylamine, N,N-diethyl-n-nonylamine, N,N-diethyl-iso-nonylamine, N,N-diethyl-n-decylamine, N,N-diethyl-2-propylheptylamine, N,N-diethyl-n-undecylamine, N,N-diethyl-n-dodecylamine, N,N-diethyl-n-tridecylamine, N,N-diethyl-iso-tridecylamine, N,N-diethyl-n-tetradecyl-amine, N,N-diethyl-n-hexadecylamine, N,N-di-ethyl-n-octadecylamine, N,N-diethyl-eicosylamine, N,N-diethyl-oleylamine;

N,N-di-(n-propyl)n-heptylamine, N,N-di-(n-propyl)-n-octylamine, N,N-di-(n-propyl)-2-ethylhexylamine, N,N-di-(n-propyl)-n-nonylamine, N,N-di-(n-propyl)-iso-nonylamine, N,N-di-(n-propyl)-n-decylamine, N,N-di-(n-propyl)-2-propylheptylamine, N,N-di-(n-propyl)-n-undecylamine, N,N-di-(n-propyl)-n-dodecylamine, N,N-di-(n-propyl)-n-tri-decylamine, N,N-di-(n-propyl)-isotridecylamine, N,N-di-(n-propyl)-n-tetradecylamine, N,N-di-(n-propyl)-n-hexa-decylamine, N,N-di-(n-propyl)-n-octadecylamine, N,N-di-(n-propyl)eicosylamine, N,N-di-(n-propyl)-oleylamine;

N,N-di-(n-butyl)-n-heptylamine, N,N-di-(n-butyl)-n-octylamine, N,N-di-(n-butyl)-2-ethylhexylamine, N,N-di-(n-butyl)-n-nonylamine, N,N-di-(n-butyl)-iso-nonylamine, N,N-di-(n-butyl)-n-decylamine, N,N-di-(n-butyl)-2-propyl-heptylamine, N,N-di-(n-butyl)-n-undecyl-amine, N,N-di-(n-butyl)-n-dodecylamine, N,N-di-(n-butyl)-n-tridecylamine, N,N-di-(n-butyl)-iso-tridecylamine, N,N-di-(n-butyl)-n-tetradecylamine, N,N-di-(n-butyl)-n-hexa-decylamine, N,N-di-(n-butyl)-n-octadecylamine, N,N-di-(n-butyl)-eicosylamine, N,N-di-(n-butyl)-oleyl-amine;

N-methyl-N-ethyl-n-heptylamine, N-methyl-N-ethyl-n-octylamine, N-methyl-N-ethyl-2-ethylhexylamine, N-methyl-N-ethyl-n-nonylamine, N-methyl-N-ethyl-iso-nonylamine, N-methyl-N-ethyl-n-decylamine, N-methyl-N-ethyl-2-propylheptylamine, N-methyl-N-ethyl-n-undecylamine, N-methyl-N-ethyl-n-dodecylamine, N-methyl-N-ethyl-n-tridecylamine, N-methyl-N-ethyl-iso-tridecylamine, N-methyl-N-ethyl-n-tetradecylamine, N-methyl-N-ethyl-n-hexadecylamine, N-methyl-N-ethyl-n-octadecylamine, N-methyl-N-ethyl-eicosyl-amine, N-methyl-N-ethyl-oleylamine;

N-methyl-N-(n-propyl)-n-heptylamine, N-methyl-N-(n-propyl)-n-octylamine, N-methyl-N-(n-propyl)-2-ethylhexylamine, N-methyl-N-(n-propyl)-n-nonylamine, N-methyl-N-(n-propyl)-isononylamine, N-methyl-N-(n-propyl)-n-decylamine, N-methyl-N-(n-propyl)-2-propylheptylamine, N-methyl-N-(n-propyl)-n-undecylamine, N-methyl-N-(n-propyl)-n-dodecylamine, N-methyl-N-(n-propyl)-n-tri-decylamine, N-methyl-N-(n-propyl)-iso-tri-decylamine, N-methyl-N-(n-propyl)-n-tetradecylamine, N-methyl-N-(n-propyl)-n-hexa-decylamine, N-methyl-N-(n-propyl)-n-octa-decylamine, N-methyl-N-(n-propyl)-eicosyl-amine, N-methyl-N-(n-propyl)-oleylamine;

N-methyl-N-(n-butyl)-n-heptylamine, N-methyl-N-(n-butyl)-n-octylamine, N-methyl-N-(n-butyl)-2-ethylhexylamine, N-methyl-N-(n-butyl)-n-nonylamine, N-methyl-N-(n-butyl)-iso-nonylamine, N-methyl-N-(n-butyl)-n-decylamine, N-methyl-N-(n-butyl)-2-propylheptyl-amine, N-methyl-N-(n-butyl)-n-undecylamine, N-methyl-N-(n-butyl)-n-dodecylamine, N-methyl-N-(n-butyl)-n-tridecylamine, N-methyl-N-(n-butyl)-iso-tridecylamine, N-methyl-N-(n-butyl)-n-tetradecylamine, N-methyl-N-(n-butyl)-n-hexadecylamine, N-methyl-N-(n-butyl)-n-octadecylamine, N-methyl-N-(n-butyl)-eicosylamine, N-methyl-N-(n-butyl)-oleylamine;

N-methyl-N,N-di-(n-heptyl)-amine, N-methyl-N,N-di-(n-octyl)-amine, N-methyl-N,N-di-(2-ethylhexyl)-amine, N-methyl-N,N-di-(n-nonyl)-amine, N-methyl-N,N-di-(iso-nonyl)-amine, N-methyl-N,N-di-(n-decyl)-amine, N-methyl-N,N-di-(2-propylheptyl)-amine, N-methyl-N,N-di-(n-undecyl)-amine, N-methyl-N,N-di-(n-dodecyl)-amine, N-methyl-N,N-di-(n-tridecyl)-amine, N-methyl-N,N-di-(iso-tridecyl)-amine, N-methyl-N,N-di-(n-tetra-decyl)-amine;

N-ethyl-N,N-di-(n-heptyl)-amine, N-ethyl-N,N-di-(n-octyl)-amine, N-ethyl-N,N-di-(2-ethylhexyl)-amine, N-ethyl-N,N-di-(n-nonyl)-amine, N-ethyl-N,N-di-(iso-nonyl)-amine, N-ethyl-N,N-di-(n-decyl)-amine, N-ethyl-N,N-di-(2-propylheptyl)-amine, N-ethyl-N,N-di-(n-undecyl)-amine, N-ethyl-N,N-di-(n-dodecyl)-amine, N-ethyl-N,N-di-(n-tridecyl)-amine, N-ethyl-N,N-di-(iso-tridecyl)-amine, N-ethyl-N,N-di-(n-tetradecyl)-amine;

N-(n-butyl)-N,N-di-(n-heptyl)-amine, N-(n-butyl)-N,N-di-(n-octyl)-amine, N-(n-butyl)-N,N-di-(2-ethylhexyl)-amine, N-(n-butyl)-N,N-di-(n-nonyl)-amine, N-(n-butyl)-N,N-di-(iso-nonyl)-amine, N-(n-butyl)-N,N-di-(n-decyl)-amine, N-(n-butyl)-N,N-di-(2-propylheptyl)-amine, N-(n-butyl)-N,N-di-(n-undecyl)-amine, N-(n-butyl)-N,N-di-(n-dodecyl)-amine, N-(n-butyl)-N,N-di-(n-tridecyl)-amine, N-(n-butyl)-N, N-di-(iso-tridecyl)-amine;

N-methyl-N-(n-heptyl)-N-(n-dodecyl)-amine, N-methyl-N-(n-heptyl)-N-(n-octadecyl)-amine, N-methyl-N-(n-octyl)-N-(2-ethylhexyl)-amine, N-methyl-N-(2-ethylhexyl)-N-(n-dodecyl)amine, N-methyl-N-(2-propylheptyl)-N-(n-undecyl)-amine, N-methyl-N-(n-decyl)-N-(n-dodecyl)-amine, N-methyl-N-(n-decyl)-N-(-tetradecyl)-amine, N-methyl-N-(n-decyl)-N-(n-hexadecyl)-amine, N-methyl-N-(n-decyl)-N-(n-octadecyl)-amine, N-methyl-N-(n-decyl)-N-oleylamine, N-methyl-N-(n-dodecyl)-N-(iso-tridecyl)-amine, N-methyl-N-(n-dodecyl)-N-(n-tetradecyl)-amine, N-methyl-N-(n-dodecyl)-N-(n-hexa-decyl)-amine, N-methyl-N-(n-dodecyl)-oleylamine;

Also suitable tertiary hydrocarbyl amines of formula $NR^1R^2R^3$ are monocyclic structures, wherein one of the short-chain hydrocarbyl residue forms with the nitrogen atom and with the other short-chain hydrocarbyl residue a five- or six-membered ring. Oxygen atoms and/or further nitrogen atoms may additionally be present in such five- or six-membered ring. In each case, such cyclic tertiary amines carry at the nitrogen atom or at one of the nitrogen atoms, respectively, the long-chain $C_7$- to $C_{20}$-hydrocarbyl residue. Examples for such monocyclic tertiary amines are N—($C_7$- to $C_{20}$-hydrocarbyl)piperidines, N—($C_7$- to $C_{20}$-hydrocarbyl)piperazines and N—($C_7$- to $C_{20}$-hydrocarbyl)morpholines.

The inventive fuel composition may comprise further customary coadditives, as described below:

Corrosion inhibitors suitable as such coadditives are, for example, succinic esters, in particular with polyols, fatty acid derivatives, for example oleic esters, oligomerized fatty acids and substituted ethanolamines.

Demulsifiers suitable as further coadditives are, for example, the alkali metal and alkaline earth metal salts of alkyl-substituted phenol- and naphthalenesulfonates and the alkali metal and alkaline earth metal salts of fatty acid, and also alcohol alkoxylates, e.g. alcohol ethoxylates, phenol alkoxylates, e.g. tert-butylphenol ethoxylates or tert-pentylphenol ethoxylates, fatty acid, alkylphenols, condensation products of ethylene oxide and propylene oxide, e.g. ethylene oxide-propylene oxide block copolymers, polyethyleneimines and polysiloxanes.

Dehazers suitable as further coadditives are, for example, alkoxylated phenolformaldehyde condensates.

Antifoams suitable as further coadditives are, for example, polyether-modified poly-siloxanes.

Antioxidants suitable as further coadditives are, for example, substituted phenols, e.g. 2,6-di-tert-butylphenol and 2,6-di-tert-butyl-3-methylphenol, and also phenylenediamines, e.g. N,N'-di-sec-butyl-p-phenylenediamine.

Metal deactivators suitable as further coadditives are, for example, salicylic acid derivatives, e.g. N,N'-disalicylidene-1,2-propanediamine.

Suitable solvents, especially also for fuel additive packages, are, for example, nonpolar organic solvents, especially aromatic and aliphatic hydrocarbons, for example toluene, xylenes, "white spirit" and the technical solvent mixtures of the designations Shellsol® (manufacturer: Royal Dutch/Shell Group), Exxol® (manufacturer: ExxonMobil) and Solvent Naphtha. Also useful here, especially in a blend with the nonpolar organic solvents mentioned, are polar organic solvents, in particular alcohols such as tert-butanol, isoamyl alcohol, 2-ethylhexanol and 2-propylheptanol.

When the coadditives and/or solvents mentioned are used in addition in gasoline fuel, they are used in the amounts customary therefor.

In an especially preferred embodiment, as the at least one fuel additive (D) to be used together with the complex ester mentioned which is different from the said complex ester and has detergent action is selected from (Da) polyisobutene monoamines or polyisobutene polyamines having $M_n$=300 to 5000, having predominantly vinylidene double bonds (normally at least 50 mol-% of vinylidene double bonds, especially at least 70 mol-% of vinylidene double bonds) and having been prepared by hydroformylation of the respective polyisobutene and subsequent reductive amination with ammonia, monoamines or polyamines. Such polyisobutene monoamines and polyisobutene polyamines are preferably applied in combination with at least one mineral or synthetic carrier oil, more preferably in combination with at least one polyether-based or polyetheramine-based carrier oil, most preferably in combination with at least one $C_6$-$C_{18}$-alcohol-started polyether having from about 5 to 35 $C_3$-$C_6$-alkylene oxide units, especially selected from propylene oxide, n-butylene oxide and isobutylene oxide units, as described above.

The present invention also provides an additive concentrate which comprises at least one complex ester mentionend, and at least one fuel additive which is different from the said complex esters and has detergent action. Otherwise, the inventive additive concentrate may comprise the further coadditives mentioned above. In case of additive concentrates for gasoline fuels, such additive concentrates are also called gasoline performance packages.

The at least one complex ester mentioned is present in the inventive additive concentrate preferably in an amount of 1 to 99% by weight, more preferably of 15 to 95% by weight and especially of 30 to 90% by weight, based in each case on the total weight of the concentrate. The at least one fuel additive which is different from the complex ester mentioned and has detergent action is present in the inventive additive concentrate preferably in an amount of 1 to 99% by weight, more preferably of 5 to 85% by weight and especially of 10 to 70% by weight, based in each case on the total weight of the concentrate.

The complex ester mentioned mentioned provides for quite a series of advantages and unexpected performance and handling improvements in view of the respective solutions proposed in the art. Effective fuel saving in the operation of a spark-ignited internal combustion engine is achieved. The respective fuel additive concentrates remain homogeneously stable over a prolonged period without any phase separation and/or precipitates. Miscibility with other fuel additives is improved and the tendency to form emulsions with water is suppressed. The high level of intake valve and combustion chamber cleanliness achieved by the modern fuel additives is not being worsened by the presence of the complex ester mentioned in the fuel. Power loss in internal combustion engines is minimized and acceleration of internal combustion engines is improved. The presence of the complex ester mentioned in the fuel also provides for an improved lubricating performance of the lubricating oils in the internal combustion engine.

The examples which follow are intended to further illustrate the present invention without restricting it.

EXAMPLES

All complex esters of the following examples were prepared according to the teachings of WO 99/16849, more precisely according to the general procedure as follows:

The ratio of all three components, i.e. of mono fatty acids, of dicarboxylic acids or dimeric acids, respectively (together "diacids"), and of triols, was choosen in a way that OH and COOH groups were present in equimolar amounts. All reactants were added to the reactor and heated to approximately 140° C. Then, the temperature was stepwise increased to a maximum temperature of approximately 250° C. until the acid number was below 5 mg KOH/g. In case a tin catalyst was necessary to reach this level of residual acid number, the catalyst was removed by filtration.

The following table shows the composition of the complex esters prepared (Examples 1a, 1b and 1c are for comparison, Examples 2 and 3 are according to the present invention):

| | mono fatty acid | "diacid" | Triol |
|---|---|---|---|
| Example 1a (comparison) | oleic acid | dimeric tallow fatty acid (18 wt. % in the complex ester) | trimethylol-propane |
| Example 1b (comparison) | oleic acid | dimeric tallow fatty acid (6 wt. % in the complex ester) | trimethylol-propane |
| Example 1c (comparison) | oleic acid | dimeric tallow fatty acid (39 wt. % in the complex ester) | trimethylol-propane |
| Example 2 (invention) | isostearic acid | sebacic acid (15 wt. % in the complex ester) | pentaerythrol |
| Example 3 (invention) | $C_8$-$C_{10}$ acid | adipinic acid (13 wt. % in the complex ester) | trimethylol-propane |

Example 4: Preparation of Gasoline Performance Package "GPP 1"

150 mg/kg of the complex ester of Example 1a, 1b, 1c, 2 or 3 above were mixed with a customary gasoline performance package containing as detergent additive component Kerocom® PIBA (a polyisobutene monoamine made by BASF SE, based on a poly-isobutene with $M_n$=1000) and usual polyether-based carrier oils, Solvent Naphtha as a diluent and corrosion inhibitors in customary amounts.

Example 5: Engine Cleanliness Tests with GPP 1

In order to demonstrate that the complex esters according to the present invention of Examples 2 and 3 do not decrease engine cleanliness and that the complex esters of the art of Example 1 exhibit worse performance, the average IVD values were deter-mined with gasoline performance package of Example 4 (GPP 1) and, for comparison, with the same gasoline performance package (GPP 1) with the customary detergent additive component Kerocom® PIBA but without any complex ester, each according to CEC F-20-98 with a Mercedes Benz M111 E engine using a customary RON 95 E10 gasoline fuel and a customary RL-223/5 engine oil. The following table shows the results of the determinations:

| Additive | average IVD [mg/valve] |
|---|---|
| GPP 1 without any complex ester | 12 |
| GPP 1 with 150 mg/kg of Example 1a | 29 |
| GPP 1 with 150 mg/kg of Example 1b | 21 |
| GPP 1 with 150 mg/kg of Example 1c | 166 |
| GPP 1 with 150 mg/kg of Example 2 | 9 |
| GPP 1 with 150 mg/kg of Example 3 | 6 |

Example 6: Fuel Economy Tests

A typical low sulphur US E10 gasoline was additized with the gasoline performance package of Example 4 (GGP 1) containing 150 mg/kg the complex ester of Example 2 or 3, respectively, and used to determine fuel economy in a fleet test with three different automobiles according to U.S. Environmental Protection Agency Test Protocol, C.F.R. Title 40, Part 600, Subpart B. For each automobile, the fuel consumption was determined first with unadditized fuel and then with the same fuel which now, however, comprised the above-specified gasoline performance package in the dosage as specified above. The following fuel savings were achieved:

2004 Mazda 3, 2.0 L I4: 1.03% (with Example 2); 0.75% (with Example 3)

2012 Honda Civic, 1.8 L I4. 1.02% (with Example 2); 1.32% (with Example 3)

2010 Chevy HHR, 2.2 L I4: 1.53% (with Example 2); 1.55% (with Example 3)

On average, over all automobiles used, the result was an average fuel saving of 1.19% (with Example 2) and 1.21% (with Example 3).

Example 7: Preparation of Gasoline Performance Package "GPP 2"

150 mg/kg of the complex ester of Example 2 or 3, respectively, above were mixed with a customary gasoline performance package containing as detergent additive component Kerocom® PIBA (a polyisobutene monoamine made by BASF SE, based on a poly-isobutene with $M_n$=1000) and usual polyether-based carrier oils, kerosene as a diluent, demulsifiers and corrosion inhibitors in customary amounts.

Example 8: Storage Stability 48.0% by weight of GPP 2 above containing complex ester of Example 2 or 3, respectively, and 37.7% by weight of xylene were mixed at 20° C. and stored thereafter in a sealed glass bottle at −20° C. for 42 days. At the beginning of this storage period and then after each 7 days, the mixture was evaluated visually and checked for possible phase separation and precipitation. It is the aim that the mixture remains clear ("c"), homogeneous ("h") and liquid ("l") after storage and does not exhibit any phase separation ("ps") or precipitation ("pr"). The following table shows the results of the evaluations:

| | | |
|---|---|---|
| after 7 days | c, h, l (for Example 2) | c, h, l (for Example 3) |
| after 14 days | c, h, l (for Example 2) | c, h, l (for Example 3) |
| after 21 days | c, h, l (for Example 2) | c, h, l (for Example 3) |
| after 28 days | c, h, l (for Example 2) | c, h, l (for Example 3) |
| after 35 days | c, h, l (for Example 2) | c, h, l (for Example 3) |
| after 42 days | c, h, l (for Example 2) | c, h, l (for Example 3) |
| Result: | pass (for Example 2) | pass (for Example 3) |

The invention claimed is:

1. A method of minimizing power loss in the operation of an internal combustion engine, consisting of:

adding to a fuel a complex ester obtained by an esterification reaction between (A) at least one aliphatic linear or branched $C_2$- to $C_{12}$-dicarboxylic acid, (B) at least one aliphatic linear or branched polyhydroxy alcohol with 3 to 6 hydroxyl groups, and (C) as a chain stopping agent (C1) at least one aliphatic linear or branched $C_1$- to $C_{30}$-monocarboxylic acid in case of an excess of component (B), or (C2) at least one aliphatic linear or branched monobasic $C_1$- to $C_{30}$-alcohol in case of an excess of component (A).

2. The method of claim 1, wherein component (A) is at least one member selected from the group consisting of aliphatic linear $C_6$- to $C_{10}$-dicarboxylic acids.

3. The method of claim 1, wherein component (B) is at least one member selected from the group consisting of glycerin, trimethylolpropane and pentaerythritol.

4. The method of claim 1, wherein component (C) is at least one member selected from the group consisting of (C1) aliphatic linear or branched $C_8$- to $C_{18}$-monocarboxylic acids, and (C2) linear or branched $C_8$- to $C_{18}$-alkanols.

5. The method of claim 1, wherein the complex ester is composed of from 2 to 9 molecule units of component (A) and of from 3 to 10 molecule units of component (B), component (B) being in excess compared with component (A), with remaining free hydroxyl groups of (B) being completely or partly capped with a corresponding number of molecule units of component (C1).

6. The method of claim 1, wherein the complex ester is composed of from 3 to 10 molecule units of component (A) and of from 2 to 9 molecule units of component (B), component (A) being in excess compared with component (B), with remaining free carboxyl groups of (A) being completely or partly capped with a corresponding number of molecule units of component (C2).

* * * * *